United States Patent [19]

Kercheval et al.

[11] 4,134,112

[45] Jan. 9, 1979

[54] VAPOR-SENSING PROTECTIVE SYSTEM

[75] Inventors: Frank T. Kercheval, 932 Palm, St. Charles, Mo. 63301; Joseph A. Kretschmer, St. Ann, Mo.

[73] Assignee: Frank T. Kercheval, St. Charles, Mo.

[21] Appl. No.: 693,217

[22] Filed: Jun. 4, 1976

[51] Int. Cl.[2] ..... G08B 17/10

[52] U.S. Cl. ..... 340/632; 114/211

[58] Field of Search ..... 340/237 R, 249; 114/211; 307/9

[56] References Cited

U.S. PATENT DOCUMENTS

| | | | |
|---|---|---|---|
| 3,789,231 | 1/1974 | Hayden | 340/237 R X |
| 3,886,535 | 5/1975 | Cirincione | 340/237 R |
| 3,948,202 | 4/1976 | Yoshikawa | 340/237 R X |

*Primary Examiner*—John W. Caldwell, Sr.
*Assistant Examiner*—Daniel Myer
*Attorney, Agent, or Firm*—Rogers, Eilers & Howell

[57] ABSTRACT

The vapor-sensing protective system of the present invention has a sensing device for fuel vapor which is mounted in an area where a fuel-powered engine is located. That sensing device develops a voltage within a predetermined range whenever it is operative and is properly connected in that system and senses for but does not detect fuel vapor; and that system responds to that voltage to permit starting of that engine. If that sensing device is not operative or is not properly connected in that system, it will be unable to develop a voltage within that predetermined range; and hence that system will prevent starting of that engine. If that sensing device is operative and is properly connected in that system and senses for and detects fuel vapor, it will develop a voltage above that predetermined range; and hence that system will prevent starting of that engine.

16 Claims, 3 Drawing Figures

STARTER SOLENOIDS
FUEL VAPOR SENSING DEVICE
NORMALLY-OPEN SWITCH

VAPOR-SENSING PROTECTIVE SYSTEM

BACKGROUND OF THE INVENTION

The engines of pleasure boats frequently use gasoline as fuel; and gasoline fumes can, occasionally, accumulate in the engine compartments of such boats. In a number of instances, admixed gasoline fumes and air in the engine compartments of pleasure boats have ignited when the engines of those boats were being started; and the ensuing explosions have caused death or serious injury to the occupants of those boats. Blowers usually are mounted in the engine compartments of pleasure boats, and those blowers are supposed to be operated for a number of minutes prior to the starting of the engines; but the operators of pleasure boats do not always remember to operate those blowers before they try to start the engines of those boats. As a result, the starting of gasoline-fueled engines on pleasure boats can be hazardous.

Prior Art

A number of control systems have been proposed which utilize vapor-sensing devices to determine whether fuel vapors are in the engine compartments of boats. Many of those control systems are not able to prevent starting of the boat engines, even if fuel vapor is adjacent those engines, and, instead, merely respond to the presence of fuel vapor to deflect the needle of a meter, to illumine a lamp or to actuate an annunciator. If the sensing devices of most of those control systems become defective or disconnected, those control systems do not effectively notify the operator of the boat of that fact.

SUMMARY OF THE INVENTION

The vapor-sensing protective system of the present invention has a sensing device for fuel vapor which is mounted in an area where a fuel-powered engine is located. That sensing device develops a voltage within a predetermined range whenever it is operative and is properly connected in that system and senses for but does not detect fuel vapor; and that system responds to that voltage to permit starting of that engine. If that sensing device is not operative or is not properly connected in that system, it will be unable to develop a voltage within that predetermined range; and hence that system will prevent starting of that engine. If that sensing device is operative and is properly connected in that system and senses for and detects fuel vapor it will develop a voltage above that predetermined range; and hence that system will prevent starting of that engine. It is, therefore, an object of the present invention to provide a vapor-sensing protective system for an engine that will permit energization of that engine whenever a sensing device provides a voltage within a predetermined range and that will prevent energization of that engine whenever that sensing device provides a voltage above or below that predetermined range, and that uses a sensing device which develops a voltage within that predetermined range whenever it is operative and is properly connected in that system and senses for but does not detect fuel vapor, which is unable to develop a voltage within that predetermined range whenever it is inoperative or is disconnected from that system, and which will develop a voltage above that predetermined range whenever it is operative and is properly connected in that system and senses for and detects fuel vapor.

Unlike some sensing devices, the sensing device of the vapor-sensing protective system of the present invention does not experience loss of sensitivity to fuel vapor as it ages or is contacted by water or fuel. As a result, that sensing device will, as long as it does not fail "open" or "closed", develop a first predictable response to the absence of fuel vapor and also will develop a second and different predictable response to the presence of fuel vapor. The vapor-sensing protective system of the present invention response to the first predictable response of that sensing device to permit energization of an engine, responds to the second predictable response of that sensing device to prevent energization of that engine, and also will respond to a failed "open" or failed "closed" condition of the sensing device to prevent energization of that engine. It is, therefore, an object of the present invention to provide a sensing device that will, as long as it does not fail "open" or "closed", develop a first predictable response to the absence of fuel vapor and a second and different predictable response to the presence of fuel vapor, and to provide a vapor-sensing protective system which responds to the first predictable response of that sensing device to permit energization of an engine, which responds to the second predictable response of that sensing device to prevent energization of that engine, and which responds to a failed "open" or failed "closed" condition of that sensing device to prevent energization of that engine.

The sensing device of the vapor-sensing protective system of the present invention is not able, as soon as that vapor-sensing protective system is turned "on", to sense for and detect the presence or absence of fuel vapor. Imstead, that sensing device requires a short but finite period of time in which to become stabilized; and that period of time is not fixed and definite because the ambient temperature can vary the length of that period of time. The vapor-sensing protective system of the present invention provides a fixed time delay during which the sensing device thereof can begin to stabilize, and that sensing device can prolong that time delay until it becomes stabilized. That sensing device thus coacts with that vapor-sensing protective system to provide a time delay which has a variable duration that is long enough to permit that sensing device to become stabilized but that does not needlessly delay the starting of the engine. It is, therefore, an object of the present invention to provide a vapor-sensing protective system that coacts with the sensing device thereof to provide a time delay which has a variable duration that is long enough to permit that sensing device to become stabilized but that does not needlessly delay the starting of the engine.

The vapor-sensing protective system of the prevent invention applies a voltage to the "line" terminal of the sensing device thereof, and that sensing device develops a reduced voltage at the output terminal thereof. A voltage-reducing means receives the reduced voltage at the output terminal of that sensing device and supplies a still lower voltage to that vapor-sensing protective system to enable that vapor-sensing protective system to permit or prevent the energization of an engine. The reduction in voltage provided by the sensing device coacts with the reduction in voltage provided by the voltage-reducing means to make the still lower voltage that is supplied to the vapor-sensing protective system essentially insensitive to variations in line voltage. It is, therefore, an object of the present invention to provide a vapor-sensing protective system which applies a voltage to the "line" terminal of the sensing device thereof, to provide a sensing device that develops a reduced voltage at the output terminal thereof, to provide a voltage-reducing means which receives the reduced voltage at the output terminal of that sensing device and supplies at still lower voltage to that vapor-sensing protective system to enable that vapor-sensing protective system to permit or prevent the energization of an engine.

The control circuitry of the vapor-sensing protective system provided by the present invention is located immediately adjacent the sensing device, so short, low-resistance conductors can be used to interconnect that sensing device with that control circuitry. As a result, that vapor-sensing protective system is not subject to the loss in sensitivity or reliability to which control systems, that have the control circuitry thereof located adjacent the dashboards of the boats and the sensing devices thereof located in the engine compartments, are subject. it is, therefore, an object of the present invention to provide a vapor-sensing protective system which has the sensing device thereof disposed in the engine compartment of a boat and which has the control circuitry thereof disposed near that sensing device.

The vapor-sensing protective system of the present invention immediately actuates a buzzer and illumines a warning lamp, and then continues to actuate that buzzer and to illumine that warning lamp until the sensing device determines that no fuel vapor is present in the engine compartment. This is desirable, because it lets the operator of the boat know that the vapor-sensing protective system, rather than an insufficiently-charged battery, a lack of fuel, or an engine failure is delayig the starting of the engine. Moreover, if the actuation of the buzzer and the illumination of the warning lamp continue long enough to indicate that fuel vapor is present in the engine compartment, the buzzer and the warning lamp will remind the operator of the boat to aerate the engine compartment before he attempts to by-pass the control circuitry. It is, therefore, an object of the present invention to provide a vapor-sensing protective system which immediately actuates a buzzer and illumines a warning lamp, and then continues to actuate that buzzer and to illumine that warning lamp until the sensing device determine that no fuel vapor is present in the engine compartment.

The vapor-sensing protective system of the present invention will automatically cause the buzzer to become silent and will automatically cause the warning lamp to become dark when the sensing device indicates that no fuel vapor is in the engine compartment. Thereupon, the operator of the boat can safely start the engine by actuating the ignition switch. Subsequently, if fuel vapor were to accumulate in the engine compartment while the engine was operating, as could happen if a leak developed in the gasoline line or in the carburetor, the vapor-sensing protective system would permit the engine to continue to operate but would immediately cause the buzzer and the warning lamp to indicate to the operator of the boat that fuel vapor was present in the engine compartment. Thereupon, if it was safe to stop the engine, the operator would do so by opening the ignition switch. However, if the boat was in the path of a larger and heavier boat, or if it was being forced by wind or tide toward a perilous shoal, falls or shore, the operator could continue to operate the engine until it was safe to stop it. It is, therefore, an object of the present invention to provide a vapor-sensing protective system which will, if it senses fuel vapor while the engine is operating, immediately signal to the operator of the boat the presence of such fuel vapor but will permit the engine to continue to operate.

Other and further objects and advantages of the present invention should become apparent from an examination of the drawing and accompanying description.

In the drawing and accompanying description a preferred embodiment of the present invention is shown and described but it is to be understood that the drawing and accompanying description are for the purpose of illustration only and do not limit the invention and that the invention will be defined by the appended claims.

BRIEF DESCRIPTION OF THE DRAWING in the drawing, FIG. 1 is a schematic diagram of one preferred embodiment of vapor-sensing protective system provided by the present invention, FIG. 2 is a diagrammatic showing of the engine compartment and dashboard of a boat in which the vapor-sensing protective system of the present invention is mounted, and FIG. 3 is a schematic diagram of a modification for part of the schematic diagram of FIG. 1.

DETAILED DESCRIPTION OF THE PREFERRED EMBODIMENT

Figures 1, 2, 3:
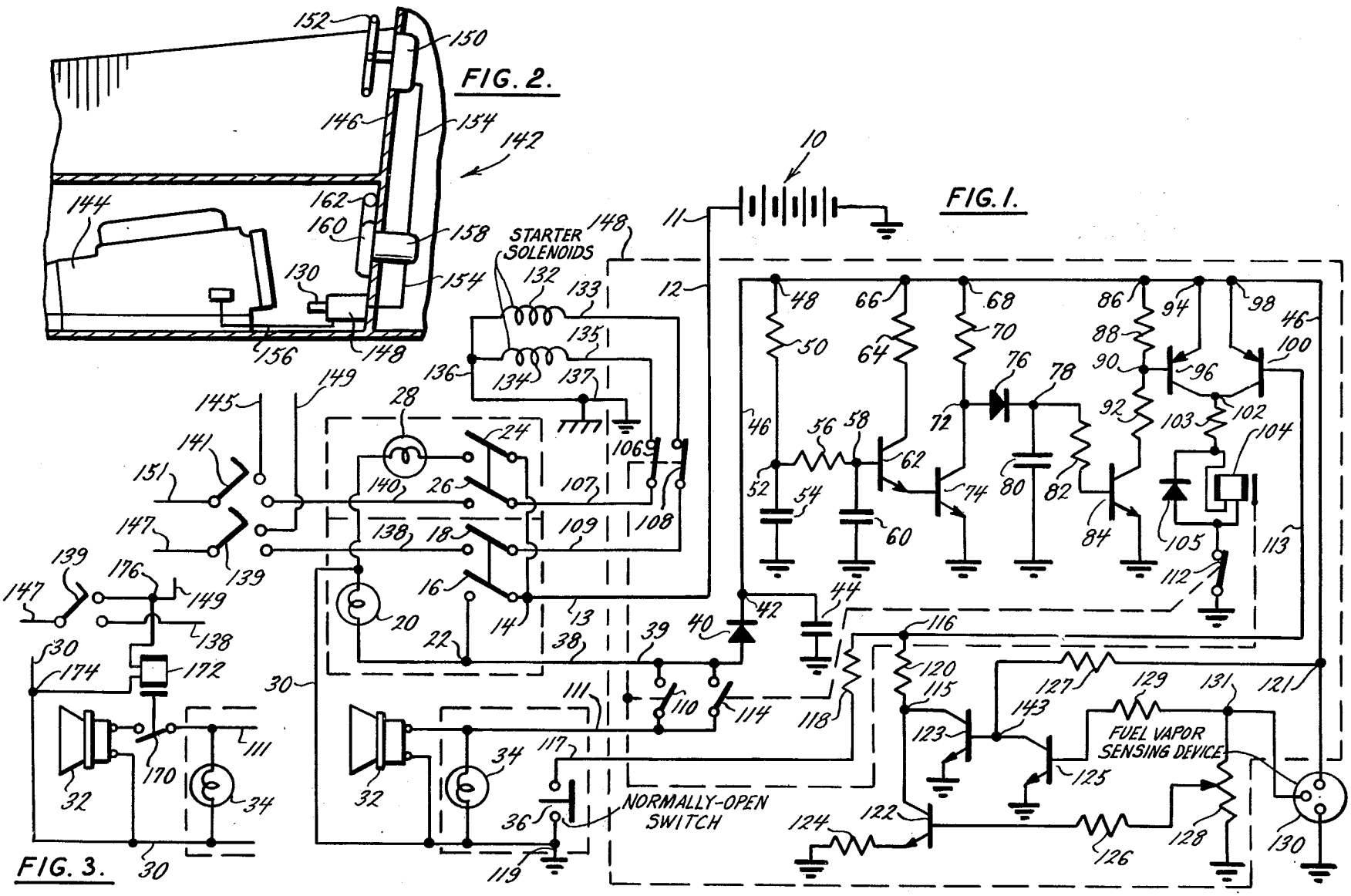

Referring to FIG. 1, the numeral 10 denotes the twelve volt battery of a boat; and that battery is located in the engine compartment of that boat. The negative terminal of the battery 10 is grounded, but a conductor 11, a conductor 12, and a conductor 13 connect the positive terminal of that battery to a junction 14 adjacent the dashboard 150 of the boat. The numeral 16 denotes one pole of a double pole single throw switch which is mounted on the dash board 150. That pole is connected to the junction 14; and it is selectively engageable with a stationary contact which is connected to an incandescent lamp 20 by a junction 22. That lamp preferably is mounted behind a green lens. The numeral 18 denotes the other pole of the double pole single throw switch.

The numeral 24 denotes one pole of a second double pole single throw switch which is mounted on the dash board 150; and that pole also is connected to the junction 14. That pole is selectively engageable with a stationary contact which is connected to one terminal of a second incandescent lamp 28. That lamp also preferably is mounted behind a green lens. The other pole of the second double pole single throw switch is denoted by the numeral 26. The other terminals of the lamps 20 and 28 are connected to ground by a conductor 30 and a conductor 119. As indicated by dotted lines in FIG. 1, the lamp 20 and the poles 16 and 18 with their stationary contacts are encased within one small housing, while the lamp 28 and the poles 24 and 26 with their stationary contacts are encased within another small housing. In the preferred embodiment of the present invention, the lamp 20 and the green lens therefor are parts of the actuator for the poles 16 and 18, and the lamp 28 and the green lens therefor are parts of the actuator for the poles 24 and 26.

The numeral 32 denotes a buzzer which is mounted on, or closely adjacent to, the dashboard 150. The numeral 34 denotes an incandescent lamp which preferably is mounted behind a red lens on that dashboard. The numeral 36 denotes a normally-open switch. One terminal of the buzzer 32, one terminal of the lamp 34, and one terminal of the switch 36 are connected to ground by the conductors 30 and 119. As indicated by dotted lines in FIG. 1, the lamp 34 and the switch 36 are enclosed within a small housing.

Conductors 38 and 39 connect the junction 22 to the anode of a diode 40, to a stationary relay contact 110, and to the stationary contact for the pole 114 of a double pole single throw switch. A junction 42 connects the cathode of that diode to a conductor 46 and also to one terminal of a capacitor 44. The other terminal of that capacitor is connected to ground. A junction 48, a resistor 50, and a junction 52 connect the conductor 46 to the upper terminal of a capacitor 54 which has the lower terminal thereof connected to ground. A resistor 56 and a junction 58 connect the junction 52 to the upper terminal of a capacitor 60 and also to the base of an NPN transistor 62. The lower terminal of the capacitor 60 is connected to ground. A junction 66 and a resistor 64 connect the conductor 46 to the collector of transistor 62. The emitter of transistor 62 is connected to the base of an NPN transistor 74 which has the emitter thereof grounded. A junction 68, a resistor 70 and a junction 72 connect the conductor 46 to the collector of transistor 74, and also to the anode of a diode 76. A junction 78 connects the cathode of that diode to the upper terminal of a capacitor 80 which has the lower terminal thereof grounded. A resistor 82 connects the junction 78 to the base of an NPN transistor 84 which has the emitter thereof grounded.

A junction 86, a resistor 88, a junction 90 and a resistor 92 connect the conductor 46 to the collector of transistor 84. Junction 90 is directly connected to the base of a PNP transistor 96 which has the emitter thereof connected to conductor 46 by a junction 94. A junction 98 connects conductor 46 to the emitter of a PNP transistor 100; and the collector of that transistor is connected to the collector of transistor 96 by a junction 102. One terminal of the coil 104 of a relay is connected to the junction 102 by a resistor; and the other terminal of that coil is connected to ground by a normally closed pole 112 of the double pole single throw switch which includes the pole 114. A diode 105 is connected on parallel relation with the coil 104. The coil 104 controls normally-closed relay contact 106 which is connected to the pole 26 by a conductor 107, controls normally-closed relay contact 108 which is connected to the pole 18 by a conductor 109, and controls normally-open relay contact 110. The relay contact 110 and the pole 114 are connected to the upper terminals of buzzer 32 and of lamp 34 by a conductor 111.

A conductor 113, a junction 116, a resistor 118, and a conductor 117 connect the base of transistor 100 to the upper terminal of switch 36. A resistor 120 and a junction 115 connect the junction 116 to the collector of an NPN transistor 123 and to the collector of an NPN transistor 122. A resistor 124 connects the emitter of transistor 122 to ground. A resistor 126 connects the base of transistor 122 to the movable contact of a potentiometer 128 which has the lower terminal thereof grounded. The numeral 130 denotes a fuel vapor sensing device which has one terminal thereof connected to the conductor 46 by a junction 121, which has a second terminal thereof grounded, and which the third terminal thereof connected to the upper terminal of potentiometer 128 by a junction 131.

A junction 143 connects the base of transistor 123 to the collector of an NPN transistor 125 which has the emitter thereof grounded. A resistor 127 connects junction 121 to junction 143; and a resistor 129 connects the base of transistor 125 to the junction 131.

The numeral 132 denotes a solenoid which controls contacts, not shown, in the circuit of the starter motor of one engine of the boat; and the numeral 134 denotes a second solenoid which controls contacts, not shown, in the circuit of the starter motor of the second engine of the boat. A connector 133 connects one terminal of the solenoid 132 to stationary relay contact 108, and a conductor 135 connects one terminal of the solenoid 134 to the stationary relay contact 106. A conductor 136 connects the other terminals of the solenoids 132 and 134 to ground; and a conductor 137 connects the conductor 136 to a grounded terminal within the enclosure 148 for the control circuitry of the vapor-sensing protective system provided by the present invention.

The numeral 138 denotes a conductor which extends from the stationary contact for the pole 18 to the "starting" contact of the ignition switch 139 for the first engine of the boat. The numeral 140 denotes a conductor which extends from the stationary contact for the pole 26 to the "starting" contact of the ignition switch 141 for the second engine of the boat. That boat is generally denoted by the numeral 142 in FIG. 2; and one engine 144 of that boat is located in the engine compartment. The other engine of the boat also is in the engine compartment; but it is hidden by the engine 144. A conductor 147 extends from the ignition switch 139 to the positive terminal of the battery 10, and a conductor 149 extends to the spark coil for the engine 144. A conductor 151 extends from the ignition switch 141 to the positive terminal of the battery 10, and a conductor 145 extends to the spark coil for the second engine.

A bulkhead 146 at the forward end of that engine compartment supports the enclosure 148. The wheel 152 of the boat is rotatably mounted on the dashboard 150, as shown by FIG. 2. The numeral 154 denotes a cable which extends from the dashboard to the enclosure 148 for the control circuitry; and that cable includes conductors 13, 37, 107, 109, 111, 117 and 119. A cable 156 extends from the enclosure 148 to a point adjacent the engine 144 and the other engine, not shown; and that cable includes conductors 11, 133, 135 and 137.

The numeral 158 denotes an electric motor which is mounted on that side of the bulkhead 146 which faces away from the engine compartment. The numeral 160 denotes a blower which is disposed within the engine compartment, which is mounted on the bulkhead 146, and which is driven by the motor 158. The numeral 162 denotes an exhaust duct which extends from the blower 160 to an outlet, not shown, at the exterior of the boat.

In the normal "at rest" condition of the boat 142, the ignition switches 139 and 141 will be "open", the poles 16, 18, 24 and 26 will be "open", the switch 36 will be "open", the relay contact 110 will be "open", the pole 114 will be "open", the pole 112 will be "closed", and the relay contacts 106 and 108 will be "closed". As a result, the lamps 20, 28 and 34 will not be illumined, the buzzer 32 will not be making any noise, the capacitors 44, 54, 60 and 80 will be discharged, and all of the transistors 62, 74, 84, 96, 100, 122, 123 and 125 will be non-conductive. The solenoids 132 and 134 will be de-energized. The voltage between the grounded terminal and the left-hand terminal of the sensing device 130 will be zero; and hence the voltage across the potentiometer 128 also will be zero.

In starting the engines of the boat 142, the operator will leave the ignition switches 139 and 141 "open" but will "close" poles 16, 18, 24 and 26. The "closing" of poles 18 and 26 will not have any immediate effect, because the ignition switches 139 and 141 are left "open". The "closing" of pole 24 will illumine lamp 28; and the "closing" of pole 16 will illumine lamp 20 and also will forward bias the diode 40. Thereupon, current will flow from the positive terminal of battery 10 via conductors 11, 12 and 13, junction 14, pole 16, junction 22, conductors 38 and 39 to diode 40; and then will subdivide to flow through a number of individually-different paths. Any current in the form of noise or other transients will largely flow through capacitor 44 to ground; and hence the positive voltage at the cathode of diode 40 will be a stable positive voltage. The current which flows through conductor 46, junctions 48, 66 and 68, resistor 70, diode 76, and capacitor 80 will charge that capacitor and thereby cause a positive voltage to develop at the upper terminal of that capacitor. The resistor 82 will apply that positive voltage to the base of transistor 84; and that voltage will, almost instantaneously, rise to a value which will cause that transistor to begin to conduct at the saturation level. The resulting flow of current through conductor 46, junctions 48, 66, 68 and 86, resistor 88, junction 90, resistor 92, and transistor 84 to ground will immediately make the voltage at junction 90 less positive than the voltage at the emitter of transistor 96. Consequently, the latter transistor will immediately become conductive at the saturation level and will energize the relay coil 104—with consequent "opening" of relay contacts 106 and 108 and with consequent "closing" of relay contact 110. The energization of the relay coil 104 occurs so very rapidly after the closing of poles 18 and 26 that even if the operator of the boat were to "close" the ignition switches 139 and 141 prior to, or simultaneously with, the "closing" of those poles, the solenoids 132 and 134 could not begin to effectively close the contacts in the circuits of the starter motors of the engine 144 and of the second engine, not shown. In fact, in the said preferred embodiment of the present invention, the relay coil 104 opens the relay contacts 106 and 108 so very rapidly after the closing of poles 18 and 26 that even if the operator of the boat were to "close" the ignition switches 139 and 141 prior to, or simultaneously with, the "closing" of those poles, the voltage at the ungrounded terminals of the solenoids 132 and 134 could not reach four-tenths of a volt.

As relay coil 104 becomes energized, current will flow from the positive terminal of battery 10 via conductors 11, 12 and 13, junction 14, pole 16, junction 22, conductors 38 and 39, relay contact 110, conductor 111, buzzer 32 and lamp 34 to conductors 30 and 119, and thence to ground. Consequently, lamp 34 will become illumined and the buzzer 32 will make a very audible sound.

At the time the poles 16, 18, 24 and 26 are closed, current also flows through conductor 46, junction 48, resistor 50, and capacitor 54 to start charging that capacitor. Further current flows through conductor 46, junction 48, resistor 50, junction 52, resistor 56, junction 58, and capacitor 60 to start charging that capacitor. After about two seconds, the voltage at junction 58 will become sufficiently positive to cause the transistor 62 to start conducting at the saturation level; and, immediately, the transistor 74 also will become conductive at the saturation level. The resulting low voltage at the anode of diode 76 will back bias that diode; and no further charging current will be able to flow through the capacitor 80. Instead, that capacitor will discharge via junction 78, resistor 82, and the base-emitter circuit of transistor 84. After a predetermined length of time—wich is long enough to enable the sensing device 130 to largely stabilize the voltage which it develops across the potentiometer 128—the voltage at the junction 78 will be so low that insufficient current will flow through the base-emitter circuit of transistor 84 to keep that transistor conductive. Thereupon, transistor 96 also will become non-conductive; and, if the sensing device 130 has become stabilized and is not sensing fuel vapor, relay coil 104 will become de-energized. The diode 105 will help that relay coil dissipate the electro-magnetic energy within that relay coil as that relay coil becomes de-energized. In one preferred embodiment of the present invention, the sensing device 130 is the twelve volt fuel vapor sensing device which is marketed by the MAJIMA HONEYCOMB COMPANY of Japan; and the capacitor 80 will maintain the transistor 84 conductive for twenty-three seconds after the diode 76 becomes back biased.

During the twenty-five seconds after the pole 16 is closed — two seconds to charge capacitor 60 and twenty-three seconds to discharge capacitor 80—the voltage which the sensing device 130 develops across the potentiometer 128 will rise rather rapidly to a value which is high enough to cause enough current to flow through resistor 126, the base-emitter circuit of transistor 122, and resistor 124 to render that transistor conductive. The resulting decreased voltage at the base of transistor 100 will permit enough current to flow through the emitter-base circuit of that transistor, conductor 113, resistor 120, the collector emitter circuit of transistor 122, and resistor 124 to ground to render transistor 100 conductive at the saturation level. The rendering of the transistor 100 conductive will not have any immediate effect, because the transistor 96 is keeping the relay coil 104 energized. Unless the temperature within the engine compartment is quite cold or unless the sensing device 130 requires an unusually-long stabilization time or unless that sensing device senses fuel vapor, the voltage which that sensing device develops across the potentiometer 128 will, prior to the end of the twenty-five second period, fall below the level needed to maintain the transistor 122 conductive. As a result, at the end of the twenty-five second period, the relay coil 104 will usually become de-energized as the transistors 84 and 96 become non-conductive. However if, at the end of the twenty-five second period, the voltage which the sensing device 130 develops across the potentiometer 128 is high enough to keep transistor 122 conductive, the relay coil 104 will be kept energized by transistor 100; and hence the solenoids 132 and 134 will be kept de-energized, lamp 34 will be kept illumined, and buzzer 32 will be kept actuated. Thereafter, until the sensing device 130 becomes stabilized and senses no fuel vapors, the relay coil 104 will prevent starting of the engines, and will indicate that the failure to start is not due to battery failure, lack of fuel or engine failure. As soon as the sensing device 130 becomes stabilized and then ascertains that no fuel vapor is present, the voltage which that sensing device develops across the potentiometer 128 will decrease sufficiently to permit the transistors 122 and 100 to become non-conductive. Immediately, the relay contacts 106 and 108 will re-close, and the relay contact 110 will re-open. The darkening of lamp 34 and the de-actuation of buzzer 32 will advise the operator of the boat that he can safely close the ignition switches 139 and 141. The "closed" positions of those switches will connect the positive terminal of battery 10 to the spark coils via conductor 147, switch 139, and conductor 149 and via conductor 151, switch 141, and conductor 145. The "start" positions of those switches will energize the solenoids 132 and 134 via conductor 147, switch 139, conductor 138, pole 18, conductor 109, relay contact 108, conductor 133, solenoid 132, and conductor 136, and via conductor 151, switch 141, conductor 140, pole 26, conductor 107, relay contact 106, conductor 135, solenoid 134, and conductor 36. As soon as the engines start, the ignition switches 139 and 141 will be permitted to return from their "start" positions to their "closed" positions.

It will be noted that as soon as the poles 16 and 18 are closed, the transistors 84 and 96 will become conductive to disable the solenoids 132 and 134, to illumine the lamp 34, and to actuate the buzzer 32. Within a few seconds thereafter, the sensing device 130 will develop a voltage across potentiometer 128 which will render transistors 122 and 100 conductive; and that sensing device will keep those transistors conductive until that sensing device stabilizes and then ascertains that no fuel vapor is present.

The vapor-sensing protective system of the present invention automatically initiates the twenty-five second time delay whether the sensing device 130 is surrounded by fresh air or by fuel vapor. As a result, if the buzzer 32 remains actuated and the lamp 34 remains illumined for more than twenty-five seconds, the operator of the boat will know that the time delay period has been initiated and terminated, and that the sensing device 130 has not become stabilized or is sensing for and is detecting fuel vapor.

If at any time when the relay coil 104 is energized, the operator of the boat wishes to go to the engine compartment of the boat and de-energize that relay coil, he can do so by opening the normally-closed pole 112 which is located in that compartment. However, as the pole 112 is opened the pole 114 will be closed; and current will flow from the positive terminal of battery 10 via conductors 11, 12 and 13, pole 16, conductors 38 and 39, pole 114, conductor 111, buzzer 32 and lamp 34, and conductor 19 to ground. This means that the operator of the boat will immediately be warned that he has disabled the vapor-sensing protective system. The buzzer 32 will remain actuated and the lamp 34 will remain illumined as long as the pole 114 is left closed, and hence will continue to warn the operator that he has disabled the vapor-sensing protective system.

As the double pole single throw switch which includes the poles 112 and 114 is actuated by the operator of the boat, it "makes" the circuit to the buzzer 32 and to the lamp 34, and it "breaks" the circuit to the relay coil 104. In making the circuit to that buzzer and that lamp, that double pole single throw switch provides a direct and positive hard-wired connection from battery 10 to that buzzer and to that lamp. In breaking the circuit to the coil 104, that double pole single throw switch positively and automatically prevents that relay coil from disabling the solenoids 132 and 134. All of this means that the double pole single throw switch provides positive disabling of those solenoids, and hence of the starter motors for the engines of the boat, and also provides positive and continuous actuation of the buzzer 32 and positive and continuous illumination of the lamp 34.

If the operator of the boat did not, when that boat reached its mooring, restore the poles 112 and 114 to their normal positions, the buzzer 32 would automatically be actuated and the lamp 34 would automatically be illuminated when the operator of the boat next closed the pole 16. In this way, the vapor-sensing protective system provided by the present invention will automatically provide audible and visible warnings which will alert the operator of the boat to the fact that the vapor-sensing protective system still is disabled. In response to those audible and visible warnings, the operator should re-close pole 112 and re-open pole 114.

In the event a leak develops in a fuel line or in a carburetor while the engines are operating, the sensing device 130 will detect the resulting fuel vapor and will increase the voltage which it develops across the potentiometer 128. The resulting flow of current through the base-emitter circuit of transistor 122 will cause that transistor to become conductive at the saturation level, and will thereby cause the transistor 100 to become conductive at the saturation level. Thereupon, relay coil 104 will again become energized, and will again open relay contacts 106 and 108 while closing relay contact 110. The opening of relay contacts 106 and 108 will not de-energize either of the engines, because the solenoids 132 and 134 control only the starting of those engines. This is important because it will permit the operator of the boat to continue to operate the engines if he has to do so to extricate the boat from a dangerous position. However, the closing of the relay contact 110 will actuate the buzzer 32 and will illumine the lamp 34 to advise the operator of the boat that potentially-dangerous fuel vapor has been sensed in the engine compartment.

The sensing device 130 has zero voltage at the output terminal thereof whenever the pole 16 is open; but, almost immediately after that pole is closed, the voltage at that output terminal will start to rise. That voltage will rapidly rise to a value which corresponds to the value of the voltage which that sensing device develops at that output terminal whenever that sensing device is stabilized and senses for and detects fuel vapor. Only after that sensing device has become stabilized and senses for but does not detect fuel vapor will the voltage at the output terminal thereof decrease below the value that corresponds to the value of the voltage which appears at that output terminal when that sensing device senses for and detects fuel vapor. This is desirable; because it enables that sensing device to automatically prolong the time delay, provided by the charging of capacitor 60 and the subsequent discharging of capacitor 80, for whatever length of time that sensing device needs to become stabilized. Moreover, that sensing device automatically and immediately terminates the extended time delay as soon as that sensing device becomes stabilized and senses for but does not detect fuel vapor.

The time delay, provided by the charging of capacitor 60 and the subsequent discharging of capacitor 80, must be longer than the time during which the sensing device 130 increases the voltage at the movable contact of potentiometer 128 to a value which will render transistor 122 — and hence transistor 100 — conductive; because that sensing device cannot be expected to effect disabling of the solenoids 132 and 134 until that voltage reaches that value. That time delay should, however, be shorter than or close to the normal minimum time which that sensing device requires to become stabilized. The twenty-five second time delay, provided by the charging of capacitor 60 and the subsequent discharging of capacitor 80, is amply long to permit the sensing device 130 to increase the voltage at the movable contact of potentiometer 128 to a value in excess of one-half of a volt — which is the minimum voltage that must appear at that movable contact to render transistor 122 conductive. Further, that twenty-five second time delay is shorter than or close to the normal minimum time which some twelve volt sensing devices made by the Majima Honeycomb Company to become stabilized. The value of the capacitor 80 could be selected to provide a discharging time of less than twenty-three seconds; but that discharging time should always be at least eight seconds.

The voltage provided by the battery 10 has a rated value of twelve volts; but it can rise to as much as thirteen and a half volts, and it can fall well below twelve volts. The diode 40 applies a voltage to the "line" terminal of the sensing device 130 which is within one volt of the voltage at the position terminal of the battery 10; and that sensing device will, whenever it is stabilized and is not sensing fuel vapor, develop a voltage at the output terminal thereof which is only a small fraction of the voltage at the "line" terminal thereof. The potentiometer 128 acts as a voltage-reducing means, and the voltage at the movable contact thereof is less than the reduced voltage at the output terminal of the sensing device 130. The action of the sensing device 130 in reducing the voltage at the "line" terminal thereof to the low voltage at the output terminal thereof coacts with the voltage-reducing action of the potentiometer 128 to apply a voltage to the base of transistor 122 which is effectively insensitive to even abnormal line voltage variations. For example, as shown by the following chart, the voltage at the movable contact of the potentiometer 128 changed very little even though the voltage which was applied to the conductor 11 by a variable voltage source was varied from thirteen and one-half volts to just eight and one-half volts:

| Voltage Applied to Conductor 11 | Voltage At Junction 121 | Voltage At Junction 131 | Time Required for Sensing Device 130 To Stabilize | Voltage At Movable Contact of Potentiameter 128 |
|---|---|---|---|---|
| 13.5 | 12.6 | 1.63 | 27 | 0.45 |
| 12.5 | 11.7 | 1.42 | 27 | 0.40 |
| 11.5 | 10.7 | 1.28 | 27 | 0.35 |
| 10.5 | 9.7 | 1.21 | 27 | 0.33 |
| 9.5 | 8.7 | 1.19 | 27 | 0.33 |
| 8.5 | 7.7 | 1.56 | 1 min.47 sec. | 0.44 |

The values in the third column of the foregoing chart represent voltages which the sensing device 130 developed at its output terminal when it was stabilized and was surrounded by fresh air. All of those values are greater than one-half of a volt, and hence are great enough to forward bias the transistor 125. This means that even when the voltage that was applied to the conductor 11 was reduced by as much as thirty-seven percent, the sensing device 130 kept the transistor 125 forward biased — and thereby permitted movement of the ignition switches 139 and 141 to their "start" positions to energize the solenoids 132 and 134.

The values in the fifth column of the foregoing chart represent voltages which the sensing device 130 developed at the movable contact of the potentiometer 128 when that sensing device was stabilized and was surrounded by fresh air. Each of those voltages is less than one-half of a volt, and hence is too small to forward bias the transistor 122. This means that even when the voltage that was applied to the conductor 11 was reduced by as much as thirty-seven percent, the sensing device 130 kept the transistor 122 non-conductive, and thereby permitted the moving of the ignition switches 139 and 141 to their "start" positions to energize the solenoids 132 and 134.

The initial value in the first column of the foregoing chart was progressively reduced until it was reduced to nine and one-half volts. As that value was progresively reduced, the initial values in the third and fifth columns progressively decreased. Significantly, however, the percentage of decrease was lower in the third and fifth columns that it was in the first column. Even more importantly, the five volt decrease in the first column was scaled down to a forty-four hundredths of a volt decrease in the third column, and it was scaled down to as little as a twelve-hundredths of a volt decrease in the fifth column. In this way, the voltages at the movable contact of the potentiometer 28 are effectively rendered insensitive to minor line voltage variations — and hence they directly and closely reflect the voltage which the sensing device 130 develops at the output terminal thereof.

The values in the fifth column of the foregoing chart decreased as the voltage, applied to the conductor 11, was decreased from thirteen and one-half volts to nine and one-half volts. However, when that voltage was decreased to eight and one-half volts, the value in the fifth column increased; and further decreases in the value of the voltage applied to the conductor 11 could increase the value in the fifth column to one-half or more of a volt. In such event, the transistors 122 and 100 would become conductive; but the low value of the voltage at the junction 98 and the voltage drop across the resistor 103 would reduce the value of the voltage across the relay coil 104 to such a low value that the said relay coil could not move the relay contacts 106 and 108 to open position. As a result, even if the heavy current drain, which occurs as the starter motors of the engines are energized, were to reduce the output voltage of battery 10 to a value which would cause the sensing device 130 to develop a voltage greater than one-half of a volt at the movable contact of potentiometer 128, the resistor 103 would not permit the relay coil 104 to become energized. In one embodiment of the present invention, that resistor was a sixty-eight ohm one-half watt resistor, and the relay coil 104 could not move the relay contacts 106 and 108 to open position unless the voltage across it was at least seven and four-tenths volts. When the voltage, that was applied to the conductor 11, was reduced sufficiently to cause the sensing device 130 to make the voltage at the movable contact of potentiometer 128 exceed one-half of a volt, the voltage which resistor 103 applied to relay coil 104 was less than seven and four-tenths volts, and hence that relay coil was incapable of moving the relay contacts 106 and 108 to open position.

All of this means that the vapor-sensing protective system provided by the present invention is effectively rendered insensative to line voltage variations — even those heavy line voltage variations which can be experienced during the starting of the engines.

All of the values in the third and fifth columns of the foregoing chart increased when the sensing device 130 was exposed to various LEL mixtures, LEL is the acronym for Lower Explosive Level; and it is used as an index of the amount of explosive vapor, such as fuel vapor, in a given atmosphere. Many prior vapor-sensing systems are intended to respond to LEL mixtures in the range from twenty-five percent to one hundred percent. The vapor-sensing protective system provided by the present invention is so sensitive that it can respond to LEL mixtures in the range from ten percent to one hundred percent. Specifically, when the sensing device 130 was exposed to LEL mixtures in the range from ten percent to one hundred percent, each of the values in the third and fifth columns of the foregoing chart increased. Importantly, each of the values in the fifth column exceeded one-half of a volt, and thereby forward biased transistor 122—with consequent energization of relay coil 104. The amounts by which each of the values in the fifth column exceeded one-half of a volt increased as the concentration of the LEL mixture was increased; but, importantly all of those values exceeded one-half of a volt when the LEL percentage was as low as ten percent.

The sensing device 130 will, whenever it is operative, is properly connected in the vapor-sensing protective system, is stabilized, and is sensing for but is not detecting fuel vapor, provide a low but finite voltage at the output terminal thereof which is in the range of about one and one quarter to two and one quarter volts. The movable contact of the potentiometer 128 will be set so the voltage at that movable contact will, whenever the sensing device 130 is operative, is properly connected in the vapor-sensing protective system, is stabilized, and is sensing for but is not detecting fuel vapor, be a finite but lower voltage in the range of twenty-five hundredths to forty-five hundreths of a volt.

If the sensing device 130 were to fail "closed", it would provide a voltage at the output terminal thereof which would cause the voltage at the movable contact of potentiometer 128 to exceed one-half of a volt. In doing so, that sensing device would cause the transistor 122 to become conductive — thereby causing transistor 100 to energize relay coil 104. If that sensing device were to fail "open", were to become incapable of developing an output voltage, or were to become disconected from the circuit therefor, any voltage at the junction 131 would be in the range of from zero to less than one-half a volt. Thereupon, transistor 125 would be non-conductive and the resulting conductive states of transistors 123 and 100 would energize relay coil 104.

All of the foregoing means that the sensing device 130 develops no effective voltage at the movable contact of the potentiometer 128 if it is defective, if it is removed from or is not properly seated in the socket therefor, or if it fails "open". That sensing device quickly develops a relatively-high voltage at that movable contact at "turn on", and that relatively-high voltage continues until that sensing device becomes stabilized and senses for but does not detect fuel vapor. That sensing device develops a relatively-low but finite voltage at that movable contact when it is stabilized and no fuel vapor is present; and it develops that relatively-higher voltage at that movable contact when it is stabilized and fuel vapor is present or if it fails "closed". The vapor-sensing protective system of the present invention fully utilizes these characteristics of that sensing device to (a) actuate the buzzer 32 and illumine the lamp 34 if that sensing device is defective, is removed from or is not properly seated in the socket therefor, or fails "open" (b) make certain that the buzzer remains actuated and the lamp remains illumined until that sensing device has become stabilized and senses for but doe not detect fuel vapor, (c) de-actuate that buzzer and darken that lamp whenever that sensing device becomes stabilized and no fuel vapor is present, and (d) actuate that buzzer and illumine that lamp whenever fuel vapor is present or that sensing device fails "closed".

The transistors 125 and 123 would perform a very important function in causing transistor 100 to energize the relay coil 104 if the sensing device 130 ever became inoperative, failed "open", or was not properly connected in the vapor-sensing protective system. Specifically, those transistors would keep the operator of a boat from being lulled into a sense of security if that sensing device became inoperative, failed "open", or was not properly connected in the vapor-sensing protective system. Not only would those transistor cause the relay coil 104 to keep the operator of the boat from energizing the solenoids 132 and 134, but they would cause that relay coil to actuate the buzzer 32 and illumine the lamp 34.

As shown particularly by FIG. 2, the sensing device 130 is mounted immediately adjacent the enclosure 148 for the control circuitry; and the mounting of that sensing device immediately adjacent that enclosure is very desirable. Specifically, the effectiveness of some fuel vapor sensing devices can diminsh very perceptibly when those sensing devices are spaced away from the control circuitry therefor by lengths of wire which are as short as twenty feet. Those sensing devices tend to develop relatively-low voltages; and the ohmic resistances of even relatively-short lengths of wire can seriously attenuate such voltages. By mounting the sensing device 130 immediately adjacent the enclosure 148, the present invention essentially obviates al reductions in sensitivity and effectiveness which could arise if long conductors were interposed between that sensing device and its control circuitry. The conductors within the cable 154 can be quite long; but the lengths of those conductors will not affect the sensitivity or effectiveness of the sensing device 130. As a result, the present invention makes it possible to avoid any diminution of the sensitivity and effectiveness of the sensing device 130, and yet enables the operator of the boat to operate the vapor-sensing protective system while standing at the wheel 152.

FIG. 1 shows two ignition switches, two double pole single throw master switches, and two solenoids, because the boat 142 has two engines. If that boat was equipped with just one engine, only one ignition switch, one solenoid, and the poles 16 and 18 would be used.

If, at any time, the operator of the boat wishes to test the vapor-sensing protective system, he need only close the switch 36. Thereupon, sufficient current will flow through the emitter-base circuit of transistor 100, conductor 113, resistor 118 and switch 36 to cause that transistor to become conductive at the saturation level—with consequent energization of relay coil 104. As long as the switch 36 is held closed, that transistor will remain conductive at the saturation level, and the relay coil 104 will keep relay contact 110 closed while holding relay contacts 106 and 108 open.

The sensing device 130 is able to sense and respond to the vapors of fluids which are customarily recognized as being fuels for engines. For example that sensing device is able to sense and respond to fumes from gasoline, fumes from kerosene, and fumes from diesel fuel. In addition, that sensing device is able to sense and respond to carbon monoxide which is a gas rather than a vapor but which is intended to be comprehended by the phrase fuel vapor. All of this means that the vapor sensing protective system provided by the present invention is able to sense and respond to combustible products of combustion as well as to fumes from gasoline, fumes from kerosene, and fumes from diesel fuel which accumulate in the engine compartment of a boat. The response of the fuel vapor sensing system of the present invention to carbon monoxide will be the same as its response to fumes from gasoline, namely, preventing energization of the solenoids 132 and 134, actuation of the buzzer 32, and illumination of the lamp 34.

Some fuel vapor sensors are intended to be wired into, rather than to be plugged into the sockets of, vapor-sensing protective systems. If a fuel vapor sensor of that type were to be used in the vapor sensing protective system provided by the present invention, the removal or breaking of the wires for that fuel vapor sensor would produce an effect comparable to that which would be produced if the sensing device 130 were to be removed from, or incompletely seated within, the socket therefor.

FIG. 3 shows a modification for part of the schematic diagram of FIG. 1 — showing the buzzer 32, the lamp 34, the ignition switch 139, and the conductors 30, 111, 138, 147 and 149 of FIG. 1. In addition, FIG. 3 shows a normally-open relay contact 170 which replaces the wire that permanently connected the upper terminals of buzzer 32 and lamp 34 in FIG. 1, shows a relay coil 172 which controls that relay contact, shows a junction 174 which connects one terminal of that relay coil to conductor 30, and shows a junction 176 which connects the other terminal of that relay coil to conductor 149.

When modified in the manner indicated by FIG. 3, the vapor-sensing protective system of FIG. 1 will, when the ignition switches 139 and 141 are in their "run" positions, operate exactly in the manner described hreinbefore. Specifically, when those ignition switches are in those positions, current will flow from the positive terminal of battery 10 via conductor 147, ignition switch 139, conductor 149, junction 176, relay coil 172, junction 174, and conductors 30 and 119 to ground. The resulting energization of that relay coil will close relay contact 170 and effectively place the buzzer 32 in parallel relation with the lamp 34. This means that if, while the ignition switches 139 and 141 are in their "run" positions, the relay coil 104 is energized, the buzzer 32 and the lamp 34 will be actuated and illumined, respectively.

The modification of FIG. 3 is intended to obviate the actuation of the buzzer 32 during the time between the closing of the two master two pole single throw switches, which include the poles 16, 18, 24 and 26, and the moment when the sensing device 130 stabilizes and senses for but does not detect fuel vapor. During that time, the relay contacts 106 and 108 will be holding the solenoids 134 and 132 disabled, all as explained hereinbefore; and the lamp 34 will be giving an indication to the operator of the boat that the sensing device is not stabilized and is sensing for but is not detecting fuel vapor, all as explained hereinbefore. If the operator of the boat wanted an audible indication of the end of the stabilization period for the sensing device, he could set the ignition switchs 139 and 141 in their "run" positions as soon as he closes the pole 16.

If desired, the relay contact 170 could be replaced by a manually-operated single pole single throw switch. In such event, the connecting of the buzzer 32 in parallel with, and the disconnecting of that buzzer from, the lamp 34 would be wholly independent of the closing or opening of the ignition switch 139. However, the arrangement in FIG. 3 is preferred, because the connecting of that buzzer in parallel relation with that lamp is automatic and is not dependent upon the memory or alertness of the operator of the boat.

The lamp 34 is shown as a continuous-illumination incandescent lamp. If desired, that lamp could have a flasher connected in series relation with it. In that event, that lamp would flash whenever the relay contact 110 or the pole 114 was closed.

Whereas the drawing and accompanying description have shown and described a preferred embodiment of the present invention it should be apparent to those skilled in the art that various changes may be made in the form of the invention without affecting the scope thereof.

What I claim is:

1. A fuel vapor protective system for an engine which comprises a sensing device that can sense for and detect fuel vapor and that experiences a change in the level of conductivity thereof whenever it detects fuel vapor, a control circuit, and an isolating device that can selectively permit or prevent energization of the starter motor of said engine, said control circuit having a first controlling means that is responsive to levels of conductivity of said sensing device within a predetermined range to be in one state thereof and thereby cause said isolating device to permit energization of said starter motor, said first controlling means being responsive to a level of conductivity of said sensing device which is beyond one end of said predetermined range to be in another state thereof and thereby cause said isolating device to prevent energization of said starter motor, and said control circuit having a second controlling means that is responsive to levels of conductivity of said sensing device within said predetermined range to be in one state thereof and thereby cause said isolating device to permit energization of said starter motor, said second controlling means being responsive to a level of conductivity of said sensing device which is beyond the other end of said predetermined range to be in another state thereof and thereby cause said isolating device to prevent energization of said starter motor, said sensing device providing a level of conductivity within said predetermined range which makes certain that said first and said second controlling means are in said one state thereof whenever said sensing device is operative and is properly connected in said system and senses for but does not detect fuel vapor, said sensing device providing said level of conductivity which is beyond said one end of said predetermined range and which makes certain that said first controlling means is in said other state thereof whenever said sensing device is operative and is properly connected in said system and senses for and detects fuel vapor, and said sensing device providing said level of conductivity which is beyond said other end of said predetermined range and which makes certain that said second controlling means is in said other state thereof if said sensing becomes unable to provide a level of conductivity which is within, or which is beyond said one of, said predetermined range because it is not operative although it is properly connected in said system, whereby said first controlling means and said second controlling means coact with said sensing device and with said isolating device to revent energization of said starter motor whenever the level of conductivity of said sensing device is etiher above or below said predetermined range.

2. A fuel vapor protective system for an engine which comprises a sensing device that can sense for and detect fuel vapor and that experiences a change in the level of conductivity thereof whenever it detects fuel vapor, a control circuit, an isolating device than can selectively permit or prevent energization of the starter motor of said engine, an indicator which can be actuated to provide a readily-detectable indication, said control circuit having a first controlling means that is responsive to levels of conductivity of said sensing device within a predetermined range to be in one state thereof and thereby cause said isolating device to permit energization of said starter motor and also permit said indicator to remain un-actuated, said first controlling means being responsive to a level of conductivity of said sensing device which is beyond one end of said predetermined range to be in another state thereof and thereby cause said isolating device to prevent energization of said starter motor and also cause said indicator to become actuated to provide said readily-detectable indication and said control circuit having a second controlling means that is responsive to levels of conductivity of said sensing device within said predetermined range to be in one state thereof and thereby providing cause said isolating device to permit energization of said starter motor and also permit said indictor to remain unactuated, said second controlling means being responsive to a level of conductivity of said sensing device which is beyond the other end of said predetermined range to be in another state thereof and thereby cause said isolating device to prevent energization of said starter motor and also cause said indicator to become actuated to provide said readily-detectable indication, said sensing device providing a level of conductivity within said predetermined range which makes certain that said first and said second controlling means are in said one state thereof whenever said sensing device is operative and is properly connected in said system and senses for but does not detect fuel vapor, said sensing device providing said level of conductivity which is beyond said one end of said predetermined range and which makes certain that said first controlling means is in said other state thereof whenever said sensing device is operative and is properly connected in said system and senses for and detects fuel vapor, and said sensing device providing said level of conductivity which is beyond said other end of said predetermined range and which makes certain that said second controlling means is in said other state thereof if said sensing device becomes unable to provide a level of conductivity which is within, or which is beyond said one end of, said predetermined range because it is not operative although it is properly connected in said system, whereby said first controlling means and said second controlling means coact with said sensing device and with said isolating device to prevent energization of said starter motor and also coact with said sensing device and with said indicator to cause said indicator to become actuated to provide said readily-detectable indication whenever the level of conductivity of said sensing device is either above or below said predetermined range.

3. A fuel vapor protective system as claimed in claim 1 wherein said sensing device has two terminals across which it develops essentially no voltage when said sensing device is providing said level of conductivity beyond said other end of said predetermined range, and wherein said second controlling means repsonds to essentially no voltage across said two terminals to cause said isolating device to prevent energization of said starter motor.

4. A fuel vapor protective system as claimed in claim 1 wherein said sensing device has two terminals across which it develops a relatively-low finite voltage when said sensing device is providng said level fo conductivity within said predetermined range, and wherein said first controlling means responds to said relatively-low finite voltage to enable said isolating device to permit energization of said starter motor.

5. A fuel vapor protective system as claimed in claim 1 wherein said sensing device has two terminals across which it develops essentially no voltage when said sensing device is providing said level of conductivity beyond said other end of said predetermined range, wherein said sensing device develops a relatively-low finite voltage across said two terminals when said sensing deice is providing said level of conductivity within said predetermined range, wherein said second controling means responds to said essentially no voltage across said two terminals to prevent energization of said starter motor, and wherein said first controlling means responds to said relatively-low finite voltage to permit energization of said starter motor.

6. A fuel vapor protective system as claimed in claim 1 wherein said sensing device has two terminals across which it develops a relatively-low finite voltage when said sensing device is providing said level of conductivity within said predetermined range, wherein said sensing device develops a higher voltage across said terminals when said sensing device is providing said level of conductivity which is beyond said one end of said predetermined range, wherein said first controlling means responds to said relatively-low finite voltage to enable said isolating device to permit energization of said starter motor, and wherein said first controlling means responds to said higher voltage to cause said isolating device to prevent energization of said starter motor.

7. A fuel vapor protective system as claimed in claim 1 wherein said sensing device has two terminals across which it develops essentially no voltage when said sensing device is providing said level of conductivity beyond said other end of said predetermined range, wherein said sensing device develops a relatively-low finite voltage across said two terminals when said sensing device is providing said level of conductivity within said predetermined range, wherein said sensing device develops a higher voltage across said terminals when said sensing device is providing said level of conductivity which is beyond said one end of said predetermined range, wherein said second controlling means responds to essentially no voltage across said two terminals to cause said isolating device to prevent energization of said starter motor, wherein said first controlling means responds to said relatively-low finite voltage to enable said isolating device to permit energization of said starter motor, and wherein said first controlling means responds to said higher voltage to cause said isolating device to prevent energization of said starter motor.

8. A fuel vapor protective system as claimed in claim 1 wherein said sensing device is connected to said first and said second controlling means by short conductors, whereby the sensitivity of said fuel vapor protective system is not attenuated by the electrical resistance of long conductors.

9. A fuel vapor protective system as claimed in claim 1 wherein said sensing device and said first controlling means and second controlling means of said control circuit, are located close to said engine, wherein an indicator is remote from said engine, and wherein said indicator can provide a readily-detectable indication.

10. A fuel vapor protective system as claimed in claim 1 wherein a switch actuates said control circuit, wherein said switch has one pole which is in series relation with the ignition system of said engine, and wherein said switch has a second pole which is not in series relation with said ignition system.

11. A fuel vapor protective system as claimed in claim 1 wherein an adjustable element is connected to said sensing device, and wherein said adjustable element is adjustable to determine the concentration of fuel vapor which is needed to cause said level of conductivity provided by said sensing device to be beyond said one end of said predetermined range whenever said sensing device is operative and is properly connected in said system and senses for and detects fuel vapor.

12. A fuel vapor protective system which comprises a sensing device that can sense for and detect fuel vapor and that experiences a change in the level of conductivity thereof whenever it detects fuel vapor, a control circuit, and an indicator which can be actuated to provide a readily-detectable indication, said control circuit having a first controlling means that is responsive to levels of conductivity of said sensing device within a predetermined range to be in one state thereof and thereby permit said indicator to remain un-actuated, said first controlling means being responsive to a level of conductivity of said sensing device which is beyond one end of said predetermined range to be in another state thereof and thereby cause said indicator to become actuated to provide said readily-detectable indication, and said control circuit having a second controlling means that is responsive to levels of conductivity of said sensing device within said predetermined range to be in one state thereof and thereby permit said indicator to remain un-actuated, said second controlling means being responsive to a level of conductivity of said sensing device which is beyond the other end of said predetermined range to be in another state thereof and thereby cause said indicator to become actuated to provide said readily-detectable indication, said sensing device providing a level of conductivity within said predetermined range which makes certain that said first and said second controlling means are in said one state thereof whenever said sensing device is operative and is properly connected in said system and senses for but does not detect fuel vapor, said sensing device providing said level of conductivity which is beyond said one end of said predetermined range, and which makes certain that said first controlling means is in said other state thereof whenever said sensing device is operative and is properly connected in said system and senses for and detects fuel vapor, and said sensing device providing said level of conductivity which is beyond said other end of said predetermined range and which makes certain that said second controlling means is in said other state thereof if said sensing device becomes unable to provide a level of conductivity which is within, or which is beyond said one end of, said predetermined range because it is not operative although it is properly connected in said system, whereby said first controlling means and said second controlling means coact with said sensing device and with said indicator to provide said readily-detectable indication whenever the level of conductivity of said sensing device is either above or below said predetermined range.

13. A fuel vapor protective system as claimed in claim 1 wherein said isolating device includes a contact which is "closed" whenever power is not supplied to said system, wherein said first controlling means whenever said sensing device is operative and is properly connected to said system and is providing said level of conductivity which is beyond said one end of said predetermined range, and wherein an over-ride switch for said control circuit can be selectively actuated, wherein said control circuit responds to actuation of said over-ride switch to enable said isolating device to permit said contact to re-close and thereby permit energization of said starter motor even though said sensing device is operative and is properly connected to said system and is providing said level of conductivity which is beyond said one end of said predetermined range.

14. A fuel vapor protective system for an engine which comprises a sensing device that can sense for and detect fuel vapor and that experiences a change in the level of conductivity thereof whenever it detects fuel vapor, a control circuit, an isolating device that can selectively permit or prevent energization of the starter motor of said engine, and an indicator which can be actuated to provide a readily-detectable indication, said control circuit having a first controlling means that is responsive to levels of conductivity of said sensing device within a predetermined range to be in one state thereof and thereby cause said isolating device to permit energization of said starter motor, and also permit said indicator to remain un-actuated, said first controlling means being responsive to a level of conductivity of said sensing device which is beyond one end of said predetermined range to be in another state thereof and thereby cause said isolating device to prevent energization of said starter motor and also cause said indicator to become actuated to provide said readily-detectable indication, and said control circuit having a second controlling means that is responsive to levels of conductivity of said sensing device within said predetermined range to be in one state thereof and thereby cause said isolating device to permit energization of said starter motor and also permit said indicator to remain unactuated, said second controlling means being responsive to a level of conductivity of said sensing device which is beyond the other end of said predetermined range to be in another state thereof and thereby cause said isolating device to prevent energization of said starter motor, and also cause said indicator to become actuated to provide said readily-detectable indication, said sensing device providing a level of conductivity within said predetermined range which makes certain that said first and said second controlling means are in said one state thereof whenever said sensing device is operative and is properly connected in said system and senses for but does not detect fuel vapor, said sensing device providing said level of conductivity which is beyond said one end of said predetermined range and which makes certain that said first controlling means is in said other state thereof whenever said sensing device is operative and is properly connected in said system and senses for and detects fuel vapor, and said sensing device providing said level of conductivity which is beyond said other end of said predetermined range and which makes certain that said second controlling means is in said other state thereof if said sensing device becomes unable to provide a level of conductivity which is within, or which is beyond said one end of, said predetermined range because it is not operative, although it is properly connected in said system, whereby said first controlling means and said second controlling means coact with said sensing device and with said isolating device to prevent energization of said starter motor and also coact with said sensing device and with said indicator to cause said indicator to become actuated to provide said readily-detectable indication whenever the level of conductivity of said sensing device is either above or below said predetermined range, and an over-ride switch for said control circuit, said control circuit responding to actuation of said over-ride switch to enable said isolating device to permit energization of said starter motor even though said sensing device is operative and is properly connected in said system and senses for and detects fuel vapor, said indicator responding to actuation of said over-ride switch to become actuated to provide said readily-detectable indication even though said isolating device is permitting energization of said starter motor, said sensing device and said control circuit and said over-ride switch being located close to said engine, said indicator being located remote from said engine.

15. A fuel vapor protective system as claimed in claim 1 said sensing device has a "line" terminal and a second terminal, wherein said sensing device responds to a voltage at said "line" terminal and to the absence of fuel vapor to provide a second voltage at said second terminal which is within a predetermined voltage range that is below said voltage at said "line" terminal, and wherein a voltage-reducing means has applied to it said second voltage, wherein said voltage-reducing means responds to said second voltage to provide a third voltage at the output of said voltage-reducing means which is less than said second voltage and wherein the action of said sensing device in reducing the value of the voltage at said "line" terminal to the value of said second voltage and the action of said voltage-reducing means in reducing the value of said second voltage to the value of said third voltage coacting to make the value of any third voltage substantially insensitive to line voltage variations.

16. A fuel vapor protective system as claimed in claim 4 wherein said indicator can provide a readily-detectable visible indication, wherein a second indicator can be actuated to provide a readily-detectable audible indication, wherein an ignition switch is selectively actuatable wherein a master switch is selectively actuatable, wherein a connecting means can selectively connect said second indicator in parallel relation with or can disconnect said second indicator from the first said indicator, wherein said control circuit responds to the closing of said master switch to supply power to said sensing device, said control circuitry means responding to said predetermined control signal to actuate said second indicator, wherein said connecting means responds to positioning of said ignition switch in its "off" position to disconnect said second indicator from said first said indicator, wherein said connecting means responds to positioning of said ignition switch in its "run" position to connect said second indicator in parallel relation with said first said indicator, whereby said second indicator can not be actuated as long as said ignition switch is in its "off" position but will become energized when said ignition switch is in its "run" position if said first said indicator is actuated, and whereby the audible signal provided by said second indicator need not be heard until said ignition switch is placed in said "run" position.

* * * * *

UNITED STATES PATENT OFFICE

CERTIFICATE OF CORRECTION

Patent No. 4,134,112 Dated January 9, 1979

Inventor(s) Kercheval, Frank T.; Kretschmer, Joseph A.

It is certified that error appears in the above-identified patent and that said Letters Patent are hereby corrected as shown below:

"4" in line 2 of Claim 16 (line 11 of column 22) should be -2-.

Signed and Sealed this

*Twenty-first* Day of *August 1979*

[SEAL]

*Attest:*

*Attesting Officer*

LUTRELLE F. PARKER

*Acting Commissioner of Patents and Trademarks*